US005352088A

United States Patent [19]

Arbeus

[11] Patent Number: 5,352,088

[45] Date of Patent: Oct. 4, 1994

[54] PUMP HOUSING DEVICE

[75] Inventor: Ulf Arbeus, Lidingo, Sweden

[73] Assignee: ITT Flygt AB, Solna, Sweden

[21] Appl. No.: 147,199

[22] Filed: Nov. 3, 1993

[30] Foreign Application Priority Data

Nov. 13, 1992 [SE] Sweden ..... 9203397-6

[51] Int. Cl.[5] ..... F01D 25/24

[52] U.S. Cl. ..... 415/182.1; 415/208.3

[58] Field of Search ..... 415/206, 208.1, 208.2, 415/208.3, 182.1

[56] References Cited

U.S. PATENT DOCUMENTS

| | | | |
|---|---|---|---|
| 82,736 | 10/1868 | Mitchell | 415/208.3 |
| 297,310 | 4/1884 | Studley | 415/206 |
| 804,028 | 11/1905 | Neumann | 415/208.3 |
| 839,312 | 12/1906 | Neumann | 415/206 |
| 882,478 | 3/1908 | Neumann | 415/206 |
| 1,390,391 | 9/1921 | Skidmore, Jr. | 415/206 |

*Primary Examiner*—John T. Kwon
*Attorney, Agent, or Firm*—Menotti J. Lombardi

[57] ABSTRACT

The invention concerns a device for pump housings for centrifugal pumps for pumping of polluted liquids. In order to decrease the influence of radial force acting upon the impeller during operation, a partition wall (5) is arranged along a part of the turn in that part of the spiral formed pump housing that has the biggest diameter. In order to decrease the risk that pollutions will stick to the wall (5), it is split up into two parts (6) and (7) with an intermediate, longitudinal slot (10). The leading edges of said parts (6) and (7) are swept backwards into the slot (10).

2 Claims, 1 Drawing Sheet

PUMP HOUSING DEVICE

This invention concerns a device for centrifugal pump housings and more specifically centrifugal pumps for pumping liquids containing pollutions such as elongated fibres, rags etc.

When pumping such liquids, so-called vortex impeller pumps are often used where the impeller is arranged beside the real liquid flow which means that there is a less risk that pollutions stick to the impeller vanes and clog the pump. An example of such a pump is shown in DE GM 76 36 700.5. A disadvantage with this type of pump is that the efficiency is often low and thus other solutions must be used.

The conventional centrifugal pump is therefore often to prefer when efficiency is important. Such a pump comprises an impeller with vanes which rotate in a spiral formed pump housing and where the fluid is sucked into the center of the impeller and leaves it through a mainly tangentially directed outlet.

In order to allow larger particles to pass, the number of vanes is normally low, sometimes only one vane.

In all spiral formed pump housings it is common that the impeller shaft and its bearings are subject to heavy loads because of the radial force that occurs when the pump operates outside its nominal field. The unbalanced flow means that a pressure variation occurs that obtains a considerable radial force which is added to by the non-symmetric hydraulic design of the impeller.

In order to decrease or possibly eliminate said radial force it is known practice to arrange a partition wall in that part of the housing where the diameter has its maximum, a so-called double spiral.

The partition wall is then arranged along about 180° of the turn in such a way that the distance between the circumference of the pump impeller and the partition wall is equal with the distance between the circumference of the pump impeller and the opposite part of the pump housing wall. In this way two opposite channels are obtained around the impeller where the distance out to the housing wall in one position is equal with the distance out to the partition wall in a position turned 180° relative the first.

By help of this design the radial forces will mainly out balance each other which means that the stress on impeller shaft and bearings will be highly reduced. An example is shown in DE 3 001 1868.

The partition wall described above however causes some disadvantages when pumping polluted liquids. The leading edge which is situated in the middle of the liquid flow, thus easily catches the pollutions, especially elongated fibres. This means that the pump housing may be clogged or at least be subject to a decreasing throughlet area thus obtaining a lower efficiency. This problem is solved by help of the device stated in the claims.

The invention is described more closely below with reference to the enclosed drawings.

Figure 1:
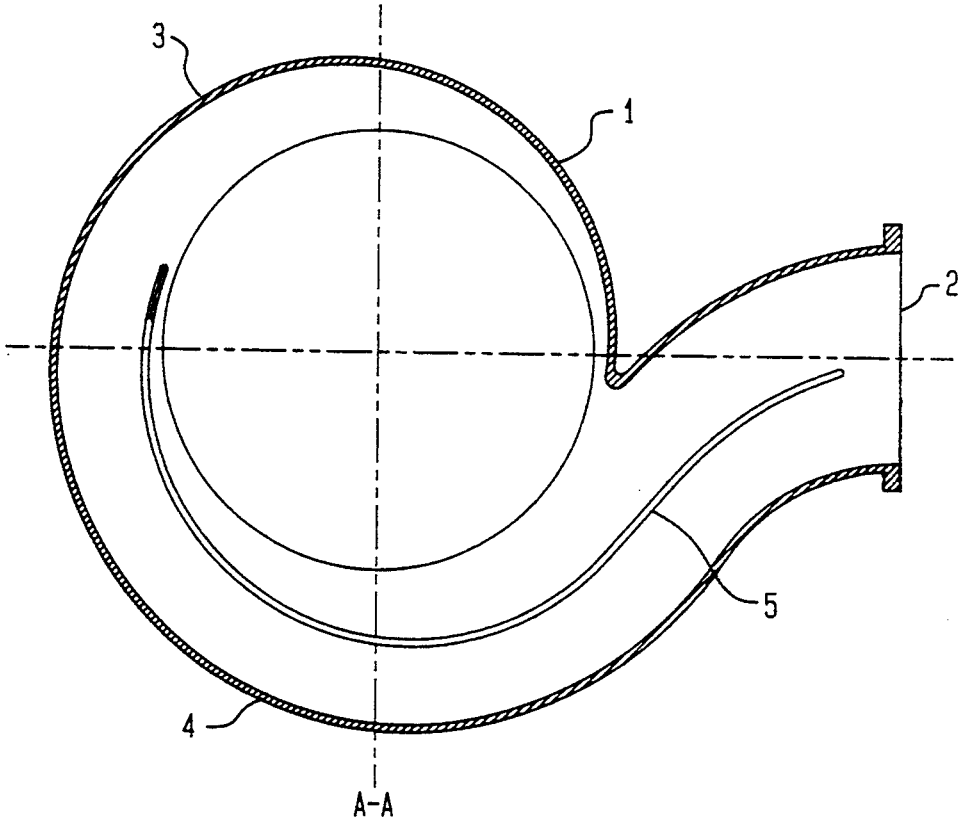
FIGS. 1 and 2 show axial and radial respective cuts through a pump housing.
Figure 2:
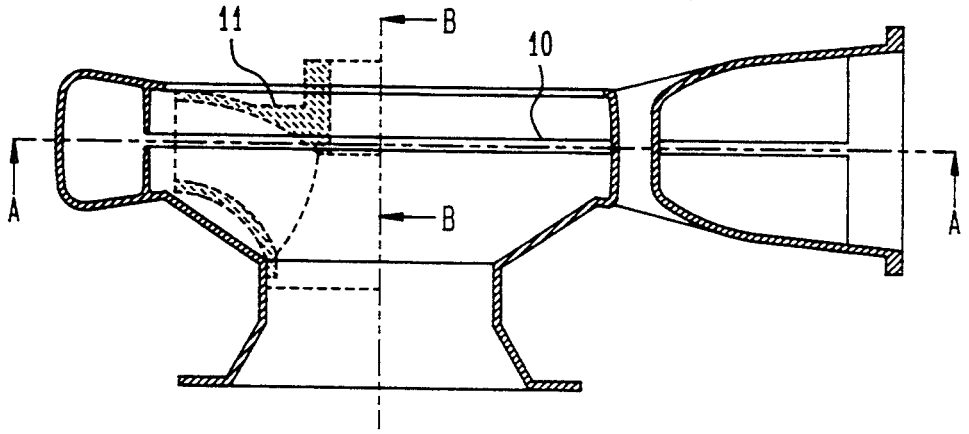
Figure 3:
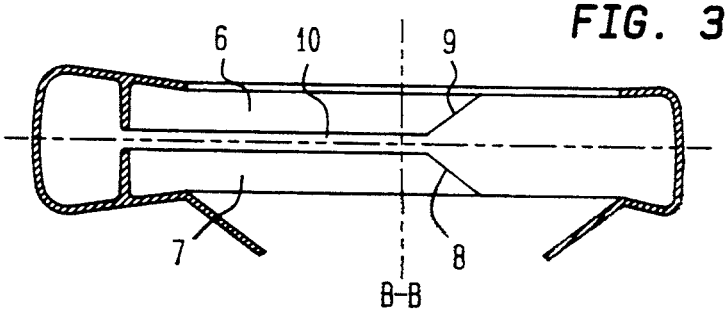
FIG. 3 shows a radial cut through a specific detail.

In the drawings 1 stands for a spiral formed pump housing with outlet 2. 3 and 4 stand for parts of its circumference, 5 a partition wall, 6 and 7 two halves of the latter having leading edges 8 and 9 respective and 10 a slot between said halves.

When the pump operates the liquid is sucked axially into the center of the pump impeller and after its passage through the impeller the liquid leaves in a mainly tangential direction through the outlet 2. In order to reduce the above mentioned reaction force, the pump housing is divided by the partition wall 5. The latter gives the housing a symmetric configuration where the partition wall balances the spiral form on the opposite side. The reaction force on the pump impeller will then in every point be balanced by an opposing corresponding force.

In order to decrease or possibly entirely eliminate the risk that rags etc will stick to the leading edge of the partition wall, the latter is divided into two parts 6 and 7 with an intermediate slot 10 through which the rags may pass without hinderance. In order to further facilitate the passage the leading edges 8 and 9 of the parts 6 and 7 respectively are swept backwards into the slot 10.

The width of the slot 10 may be varied in dependence of the type of liquid pumped. In general, the wider slot, the less effective reduction of the radial force. It is therefore necessary to compromise.

By help of the invention it has been possible to use a centrifugal pump with high efficiency under conditions which have not been possible up to now. The invention also means a simplified manufacturing as compared with the manufacturing of the known design with a full partition wall.

I claim:

1. A device for pump housings for centrifugal pumps comprising a pump impeller (11) having one or several vanes which rotate in a spiral formed pump housing (1) where the liquid is axially sucked in and leaves through a mainly tangentially directed outlet (2), the pump housing along a part of its turn being divided by an axially directed partition wall (5) the distance of which to the pump impeller circumference corresponding with the distance between said circumference and the diametrically opposite part of the pump housing, characterized in that the partition wall (5) is parted in its longitudinal direction into two parts (6, 7) by a slot (10).

2. A device according to claim 1, characterized in that the two parts (6, 7) of the partition wall have leading edges (8, 9) which are swept backwards into the slot.

* * * * *